US005216905A

United States Patent [19]

Sersch et al.

[11] Patent Number: 5,216,905

[45] Date of Patent: Jun. 8, 1993

[54] LOCK, IN PARTICULAR, FOR SUITCASES OR THE LIKE

[75] Inventors: Jürgen Sersch, Solingen; Helmut Klein, Velsert, both of Fed. Rep. of Germany

[73] Assignee: S. Franzen Söhne (GmbH & Co.), Solingen, Fed. Rep. of Germany

[21] Appl. No.: 800,499

[22] Filed: Nov. 29, 1991

[30] Foreign Application Priority Data

Nov. 30, 1990 [DE] Fed. Rep. of Germany ..... 4038218

[51] Int. Cl.[5] ..... E05B 65/48

[52] U.S. Cl. ..... 70/73; 70/312

[58] Field of Search ..... 70/73, 75, 76, 312

[56] References Cited

U.S. PATENT DOCUMENTS

| | | | |
|---|---|---|---|
| 987,265 | 3/1911 | Smith et al. | 70/312 |
| 2,798,371 | 7/1957 | Gehrie | 70/73 |
| 2,829,912 | 4/1958 | Koch | 292/114 |
| 3,043,616 | 7/1962 | Magnuson | 70/76 X |
| 3,698,753 | 10/1972 | Atkinson | 70/73 X |
| 4,420,953 | 12/1983 | Remington | 70/74 |
| 4,646,547 | 3/1987 | Scelba et al. | 70/312 |
| 4,761,974 | 8/1988 | Lii | 70/75 X |
| 4,782,673 | 11/1988 | Castelli et al. | 70/76 X |
| 4,920,771 | 5/1990 | Jiang | 70/312 X |
| 5,060,492 | 10/1991 | Carpenter et al. | 70/73 |

FOREIGN PATENT DOCUMENTS

| | | | |
|---|---|---|---|
| 0150459 | 8/1985 | European Pat. Off. . | |
| 45637 | 11/1935 | France | 70/75 |
| 2631369 | 11/1989 | France . | |
| 16379 | of 1910 | United Kingdom | 70/74 |
| 932218 | 7/1963 | United Kingdom . | |

*Primary Examiner*—Lloyd A. Gall
*Attorney, Agent, or Firm*—Martin A. Farber

[57] ABSTRACT

The present invention relates to a lock, in particular for a suitcase (1) or the like, having a bolt (22) which engages into a mating lock opening (31), is blocked in its locking engagement position and engages in swinging manner into the mating lock opening (31) and thereupon enters with longitudinal tightening into the locking position; and the position. In order to achieve easy locking and a large, tightening moment exerted by the bolt, the bolt (22) has two actuating surfaces (24, 25) on both sides of a bearing shaft (20) which is displaceable over an arcuate path, one (24) of the actuating surfaces serving for the swinging displacement of the bolt (22) into the mating lock opening (31) while the other one (25) forces the longitudinal tightening by the application of actuating pressure.

15 Claims, 7 Drawing Sheets

LOCK, IN PARTICULAR, FOR SUITCASES OR THE LIKE

FIELD AND BACKGROUND OF THE INVENTION

The present invention relates to a lock in general, and a lock for suitcases or the like, in particular.

A lock of the type in question is known from British Pat. No. 932 218, the control of the bolt taking place by means of an operating lever which swings around a fixed pivot point. This is effected via a pin/slot control between operating lever and bolt, the latter swinging into the locking position upon a shifting of the operating lever together with a longitudinal tightening movement. Such locks may be used for suitable containers but they cannot be used on suitcases due to the fact that the operating lever protrudes relatively far even in the locked position. The unintentional opening of the suitcase can then not be excluded. Furthermore, the projecting operating lever constitutes a disturbing protrusion upon transportation of the suitcase.

SUMMARY OF THE INVENTION

The object of the invention is to develop a lock of this type in such a manner that with simple space-saving construction easy locking is obtained while achieving a large tightening moment exerted by the bolt.

As a result of the development of the present invention this development there is created a lock of the type in question which is characterized in particular by a very simple space-saving construction. It is suitable for use on suitcases. In the closed position of the suitcase there are no protruding structural parts which might favor unintended opening of the suitcase by being struck. No operating lever for controlling the bolt is required. The locking of the lock of the suitcase equipped therewith is effected in the manner that the lid is first closed. The actuating surface of the bolt facing the lid of the suitcase must then be acted on, the bolt engaging for instance with its locking hook into the mating locking part opening of the suitcase lid. This is effected in the manner that the bolt swings around its bearing pin. Pressure must then be applied against the other actuating surface. As a result, the bearing pin moves over an arcuate path connected with the longitudinal pull, which forces the suitcase lid, via its mating locking part opening, into the final locked position. The abovementioned locking process is easy to carry out by actuation with two fingers. The index finger, for instance serves to swing the bolt and the thumb to move the bearing pin over the arcuate path bringing about the longitudinal tightening since it is possible to exert greater pressure by means of one's thumb. Furthermore, little suitcase space is lost due to the space-saving construction. The locking position which has been assumed by the bolt can be secured in various manners. However, for the bolt which is spring-urged in opening direction, there is particularly suitable in its locked position a latch slide which holds the bolt fast on its bottom side. The opening of the lock requires actuation of the push button adjacent to the bolt, which button causes the displacement of the latch slide with simultaneous release of the bolt. Due to the spring action exerted on it, it then moves into the opening position, releasing the suitcase lid. In the transverse direction of the suitcase, a particularly low structural height is achieved if the bolt extends transverse to the direction of the push button and of the latch slide. This means that latch slide and push button as well as bolt are at a right angle to each other. This arrangement is particularly suitable for suitcases having shell-like suitcase halves which are provided with a profile on their edges. A lock of this construction can be arranged in particularly space-saving manner there. The fact that the bearing pin is borne by a chain link also contributes to this. The chain link is swingable, limited by stop, on an articulation shaft of a lock base plate, the shaft being arranged parallel to the bearing pin. In the open position of the bolt, the latter can therefor enter into its protruding open position. In the locking position of the bolt on the other hand, the bearing pin for the bolt enters in space-saving manner into the inside of the lock due to the swinging displacement of the chain link. The chain link also performs a further task in that it holds the bolt in a defined open position by means of its stop shoulder. This open position can be such that the two actuating surfaces of the bolt extend approximately parallel to the facing wall of the suitcase. Spreading springs arranged on the bearing pin and articulation shaft facilitate the sequence of the operating steps upon the locking. The swinging of the bolt into the engagement position around the bearing pin is accordingly opposed by less resistance, so that, as intended, the locking position of the bolt which is secured by the latch slide is brought about. Due its frame-like development, the latch slide permits a space-saving internesting with the lock base plate. It is constantly urged by spring in the bolt engagement direction. By means of the push button which is formed integral with it, the latch slide then can be displaced for opening on the lock base plate, its hook releasing the pull extending from the bottom side of the bolt. Only then can the bolt enter, under spring action, into its open position. The safety value of the lock is increased by the lock mechanism which extends between push button and bolt and can block the sliding movement of the latch slide. The lock mechanism can also be arranged in space-saving manner in the overall construction of the lock. The push button of the latch slide and the bolt are accordingly separated by the locking mechanism. It is obvious that the locking mechanism can be developed as permutation lock. Its shaft which bears the setting disks thereof extends transverse to the direction of displacement of the latch slide. The symbols—for instance—numbers—on the setting disks can therefore be easily read. If the combination is properly set, the locking sleeves arranged on the shaft release a blocking rocker which permits displacement of the latch slide by means of the push button. However, if the combination is not correctly set, blocking ends of the blocking rocker protrude into the path of blocking projections on the latch-slide side. Displacement of the latch slide is then not possible. In order for all movements of lock parts to be limited by the lock itself, additional stops extend on the latch slide behind the blocking projections, a housing cap which extends over the permutational lock extending into the path of movement of said stops. When the blocking rocker is in its release position, the displacement of the latch slide is limited by the fact that the stops strike against the housing cap. A hook which secures the engaged position of lock base plate and latch slide results in advantages from an assembly standpoint. This hook extends over the facing transverse web of the frame of the latch slide in such a manner that the length of this extension is greater when the latch slide is in its blocking position than the distance between the stops and the facing edge of the housing cap. Therefore, the securing extension is not given up even in the position of displacement into the opening direction. A removal of the latch slide can only take place when the housing cap is removed. The latch slide can then be displaced to a greater extent so that the hook of the lock base plate releases the transverse web of the frame. The housing cap is such that its surface terminates with that of the bolt which has assumed its locking position and with that of the push button. In addition to a favorable appearance of the lock, it accordingly lacks any unfavorably protruding structural parts.

BRIEF DESCRIPTION OF THE DRAWING

One embodiment of the invention will be explained below with reference to the drawing, in which.

Figure 1:
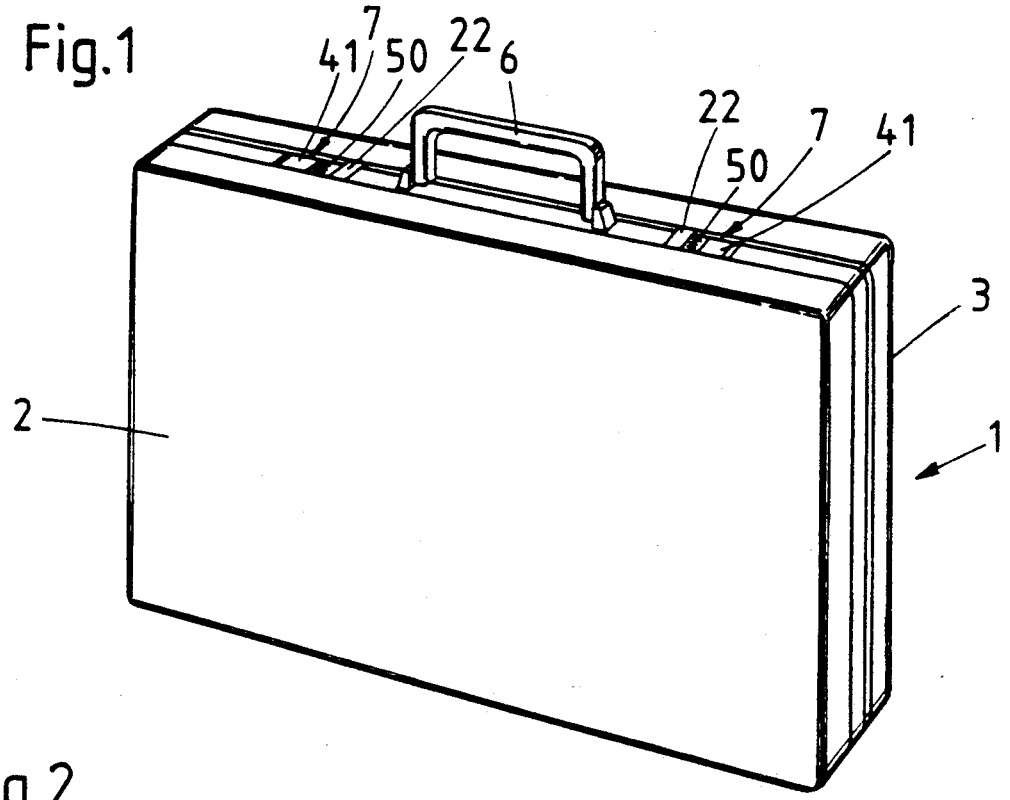
FIG. 1 is a perspective view of a suitcase having two locks developed in accordance with the invention, FIG. 2 a view of the suitcase in the region of one lock, shown in approximately actual size.
Figure 2:
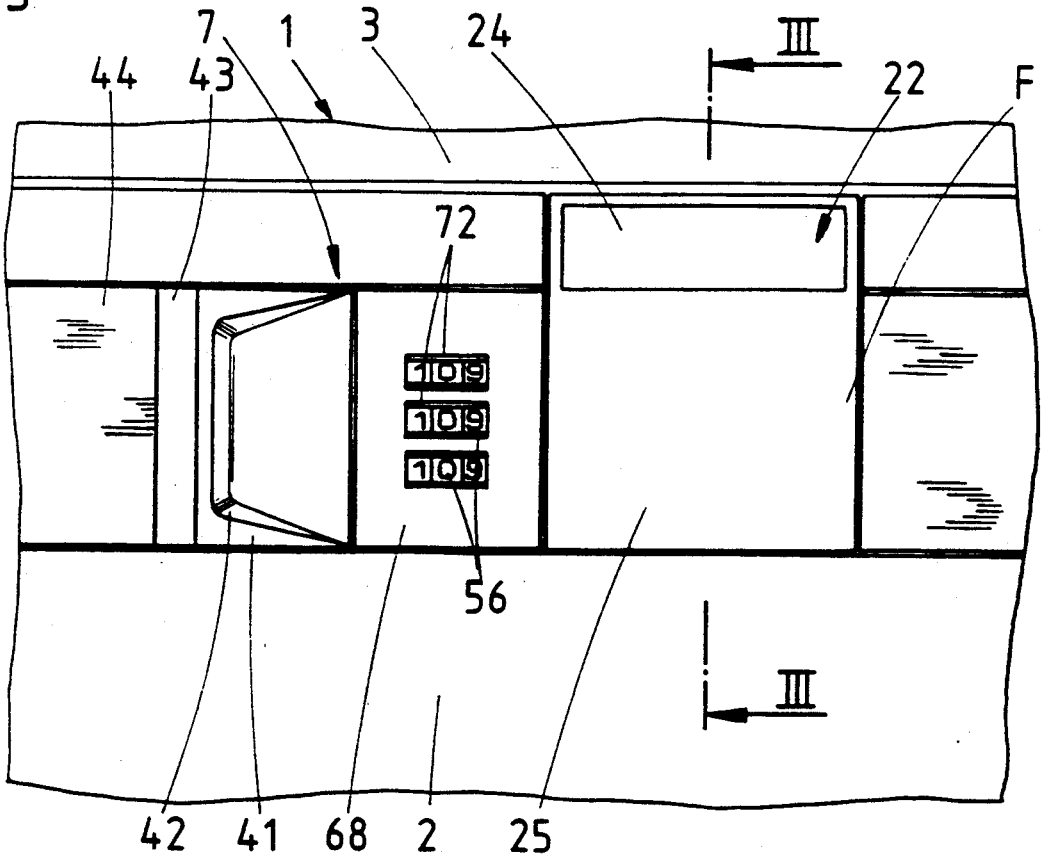

DETAILED DESCRIPTION OF THE DRAWINGS 1 designates a suitcase, the bottom 2 and lid 3 of which are shell-shaped. The facing rim edges of the bottom 2 and lid 3 of the suitcase engage within each other in the manner of profiles. For this purpose the suitcase lid 3 has a circumferential web 4 which engages into a forked opening 5 of the facing rim of the suitcase bottom 2.

On both sides of the carrying handle 6 associated with the suitcase bottom 2 there is, in each case, a lock 7. Since the two locks are developed almost identically, only a single lock 7 will be described below.

Figure 3:
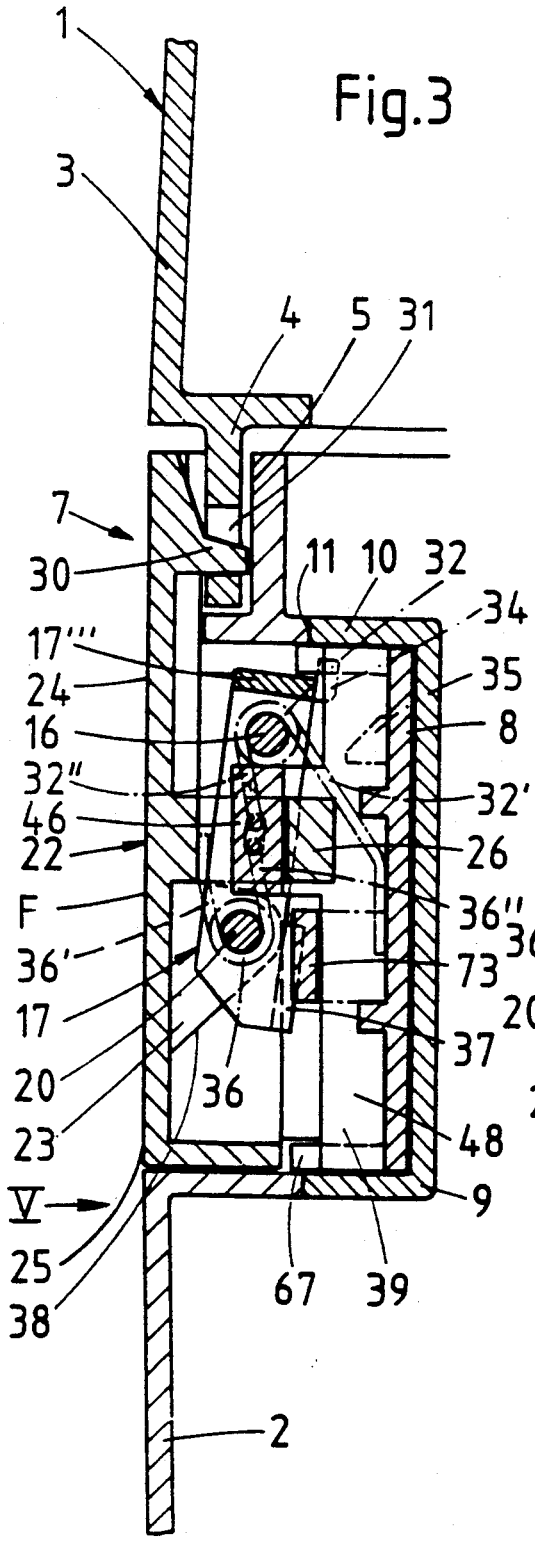
FIG. 3 is a section along the line III—III of FIG. 2, the bolt being in its locking position.

The lock 7 has a lock base plate 8 adjacent to the forked opening 5, which base plate is of longitudinal shape its length extending parallel to the rim of the suitcase bottom. On the bottom side the lock base plate 8 is covered by a lock housing cap 9 which in its turn rests with its cap edge 10 on the front edge 11 of the suitcase; bottom 2; see in particular FIGS. 3 and 4. In this way, the base plate 8 is held fast on the suitcase bottom 2 by means of attachment screws 12 passing through the lock housing cap 9. The attachment screws 12 are inserted from the inside of the suitcase and engage into end regions 13 of the lock base plate 8; see FIG. 6.

The region of the lock base plate 8 adjacent to the carrying handle 6 holds in two aligned holes 14, 15 an articulation shaft 16 for a chain link 17. The latter has a U-shaped structural shape. In the two U-arms 17′, 17″ bearing holes 18 are provided near the U-arm 17‴ connecting them, said bearing holes 18 being passed through in their turn by the articulation shaft 16. On their free ends, the U-arms 17′, 17′ are provided with additional aligned bearing holes 19. They are passed through by a bearing shaft 20, the ends of which protrude beyond the U-arms 17′, 17″ engaged in insertion openings 21 of corresponding cross section of a bolt 22. The insertion openings 21 are arranged in bearing brackets 23 extending from the bottom side of the bolt 22. The arrangement of the insertion openings 21 are such that the surface cap F of the bolt 22 on both sides of the bearing shaft 20 is divided into two actuating surfaces 24, 25. The length of the actuating surface 24 is in this connection about twice as great as that of the actuating surface 25.

Adjoining the bearing brackets 23 a pull 26 extends from the bottom side of the bolt 22. Said pull has a head 28 borne by a web 27 on which head a run-on bevel 29 is developed which extends in the longitudinal direction of the bolt 22. The pull 26 extends approximately in the longitudinal center of the bolt 22. Near the free end of the actuating surface 24 the bolt 22 forms a tightening hook 30 which protrudes towards the bottom and with which there is associated a mating closing-part opening 31 on the suitcase lid 3. The mating closing part opening 31 is in this connection arranged in the web 4 of the suitcase lid 3.

On the articulation shaft 16 there is seated a torsion spring 32. The one end 32′ thereof rests on the lock base plate 8, while the other end 32″ is bent off and engages into a central longitudinal slit 33 in the U-arm 17, In this way, the chain link 17 is urged in clockwise direction, and therefore in the direction of a spreading off from the base plate 8. The maximum spreading position of the chain link 17 is limited by a stop tongue 34 which is bent off on the U-arm 17,,, and comes against a projection 35 provided on the lock base plate 8; see in particular FIG. 4. The longitudinal direction of the chain link 17 then extends approximately at an angle of 45° to the lock base plate 8.

A torsion spring 36 is also placed on the bearing shaft 20. Its one end 36′ acts on the bottom side of the bolt 22 at the level of the actuating surface 24, while its other end 36″ also engages into the longitudinal slot 33 of the U-arm 17′. This torsion spring 36 urges the bolt 22 in counterclockwise direction around the bearing shaft 20. The swinging motion of the bolt 22 in its open position is limited by the fact that the chain link 17 has, at its two U-arms 17′, 17″, outwardly bent stop shoulders 37 against which counter stops 38 of the bolt 22 rest; see FIG. 4. The counter stops 38 are formed by the inclined flanks of the bearing pedestals 23 on the bottom side of the bolt 22. The force of the torsion spring 36 acting on the bolt 22 is in this connection less than that of the torsion spring 32 acting on the chain link 17.

A frame-shaped latch slide 39 is guided on the lock base plate 8. On its one end facing away from the bolt 22, the latch slide 39 continues via a bend 40 into a push button 41 serving for actuation. From the surface of the push button there extends a recess 42 intended for insertion of a finger of the actuating hand. The end section 43 of the push button 41 is step-shaped and extends, in installed condition of the latch slide 39, below the facing edge of a cover strip 44 of the suitcase bottom 2. A compression spring 45 arranged between the lock base plate 8 and the latch slide 39 urges the latch slide 39 in the direction of the bolt 22 in order to lock the latter in its locking position. The locking element of the latch slide 39 is a catch hook 46 which is located on the end of the latch slide 39 opposite the push button 41. The catch hook 46 extends from the transverse frame web 48 of the latch slide 39 which connects the two longitudinal arms 47 of the frame. The catch hook 46 has a latch bevel 49 which also extends in the longitudinal direction of the bolt 22. In the locked position of the bolt 22, the catch hook 49 extends over the pull 26 which extends from the bottom of the bolt 22, see in this connection, in particular, FIGS. 3 and 6.

Between the push button 41 and the bolt 22, the lock base plate 80 has a locking mechanism 50 which can block the sliding movement of the latch slide 39. Said locking mechanism is developed as permutation lock. It has two bearing plates, 51, 52 which extend parallel to each other and which engage in form-locked manner into webs 53, 54, extending from the lock base plate 8. A shaft 55 is mounted in the bearing plates 51, 52. On said shaft, setting disks 56 provided with numbers and blocking sleeves 57 cooperating with said disks are arranged. A compression spring 58 provided on the shaft 55 urges the sleeves 57 into position of engagement with the setting disks 56. On the opposite end of the shaft 55, there is a setting lever 59 by means of which it is possible, in known manner, to bring the blocking sleeves 57 out of engagement with the setting disks 56 so as to change the combination.

Figure 5:
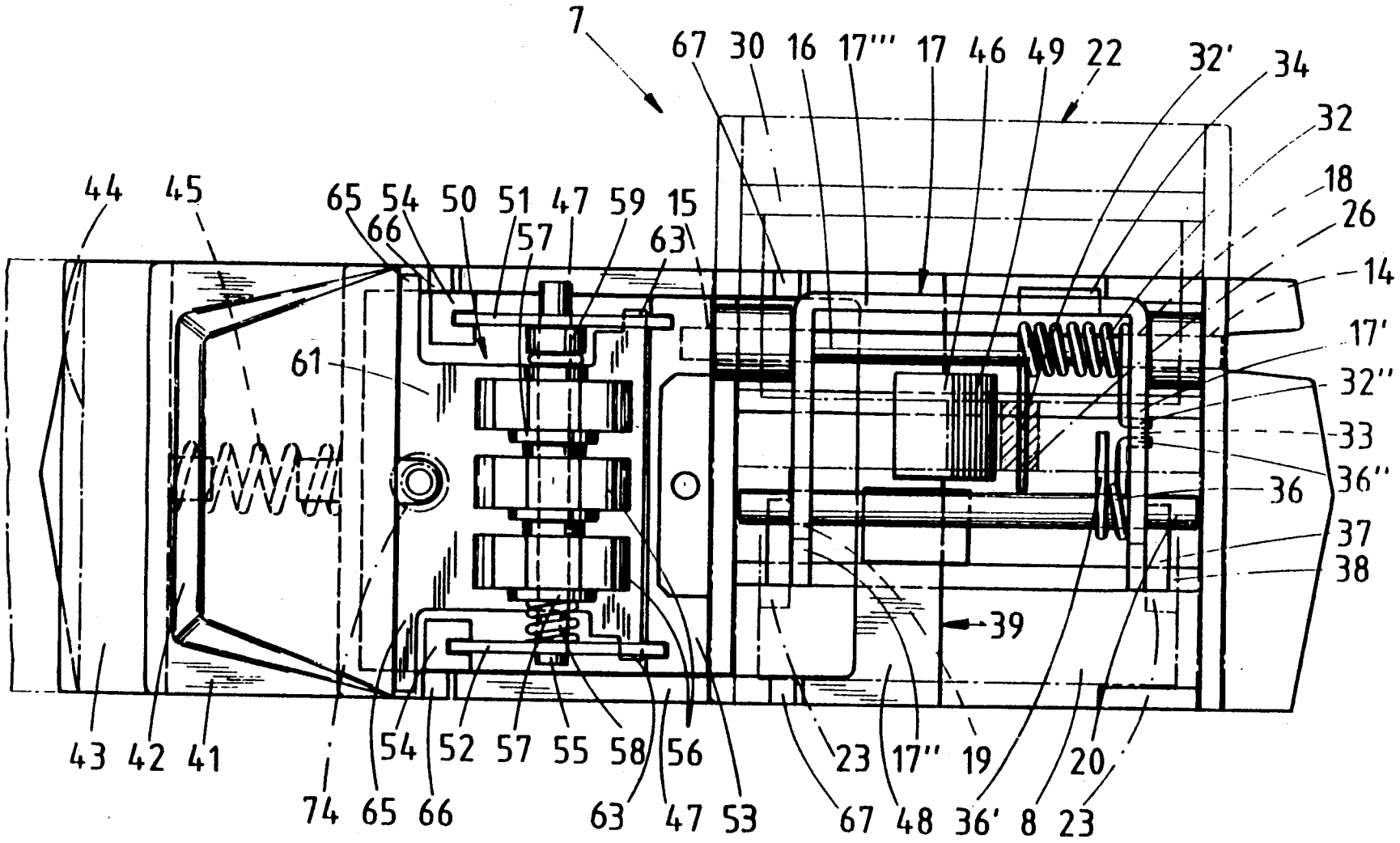
FIG. 5 is a view in the direction of the arrow V of FIG. 3, the housing cap which extends over the permutation lock being omitted, and the bolt being shown in dash-dot line.

The blocking sleeves 57 have secant-shaped flattenings 60 which cooperate with a blocking rocker 61. In their central region they have openings 62 for the passage of the setting disks 56. On the other side of the openings 62, the blocking rocker 61 is provided with laterally protruding bearing tongues 63 which engage into openings 64 in the bearing plates 51, 52. A spring 74, indicated in dash-dot line in FIG. 5, urges the blocking rocker 61 in the direction of the blocking sleeves 57. Arranged parallel to and opposite the bearing tongues 63, the blocking rocker 61 forms laterally protruding blocking ends 65. The latch slide 39 is provided on the longitudinal frame arms 47 with blocking projections 66 which are located in front of the blocking ends 65 of the blocking rocker 61 when the bolt 22 is in locking position and the combination of the permutation lock is scrambled. In this case, displacement of the latch slide 39 is not possible. The bolt 22 is accordingly not released.

Behind the blocking projections 66, additional stops 67 are formed on the longitudinal frame arms 47. A housing cap 68 which extends over the permutation lock—locking mechanism 50—lies in the path of movement of said additional stops. This housing cap 68 has a U-shaped layout. Open-edge longitudinal slots 70 are present in the U-arms 69, said slots permitting the placing on of the housing cap 68. The ends of the shaft 55, of the permutation lock extend into the longitudinal slots 70. For the setting disks 56 of the permutation lock, the U-web 71 of the housing cap 68 forms passage openings 72 in such a manner that the setting disks 56 protrude slightly and permit their displacement.

Figure 6:
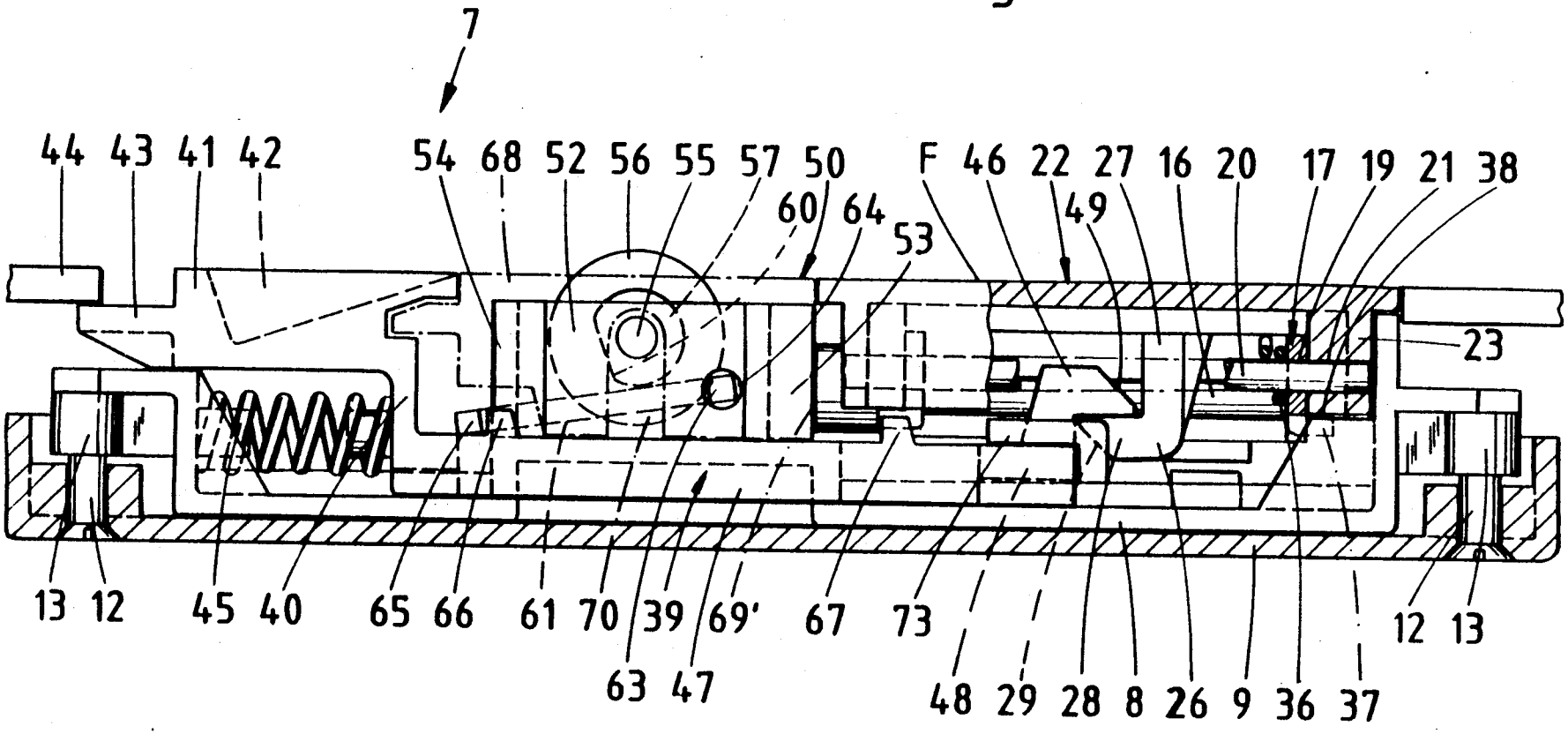
FIG. 6 shows, partially in elevation and partially in longitudinal section, the lock in the locking position of the bolt with the combination of the permutation lock scrambled.
Figure 7:
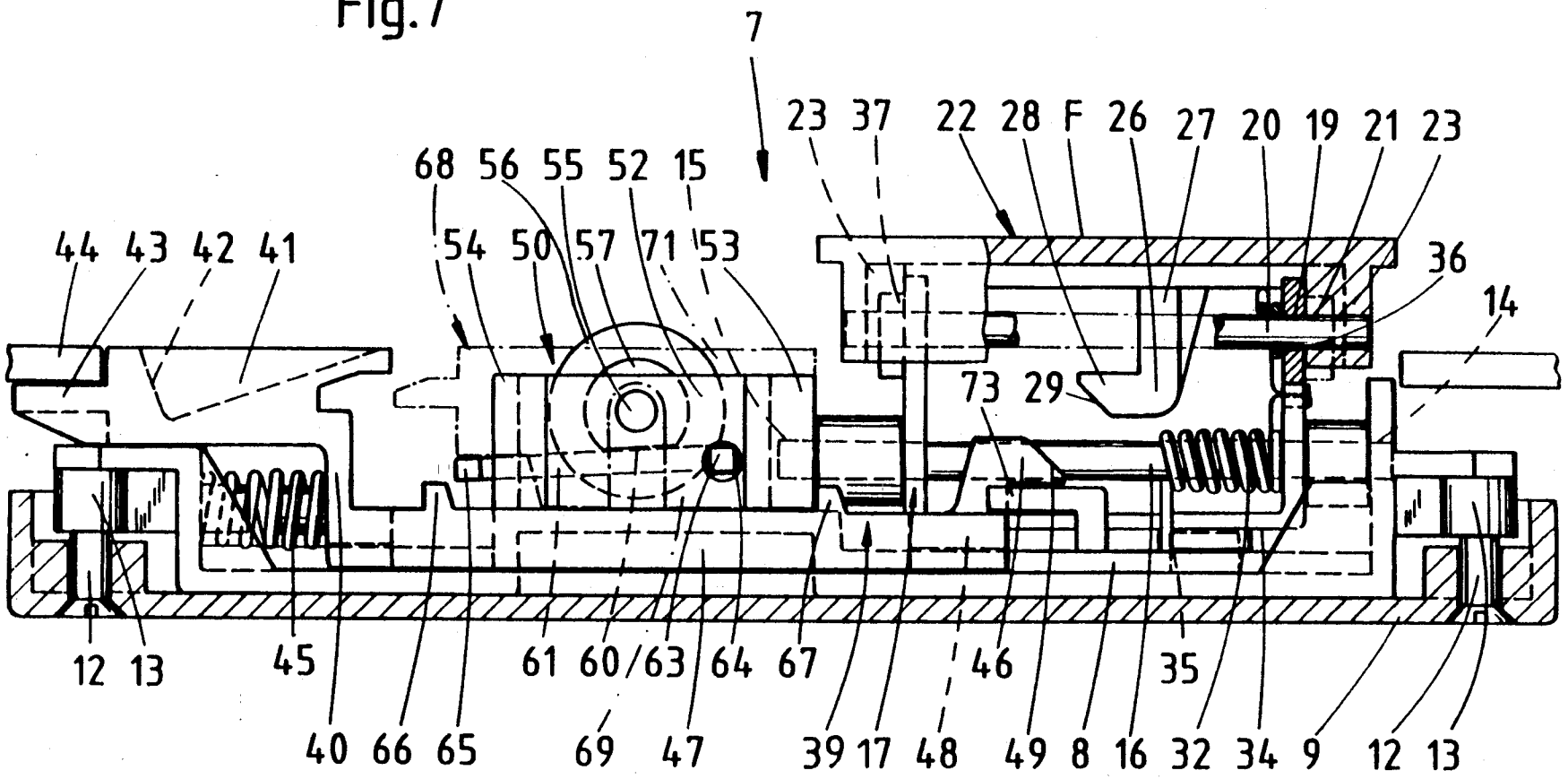
FIG. 7 is a view corresponding to FIG. 6 in which, differing from FIG. 6, the latch slide has been moved into the release position and the bolt is in the open position.
Figure 8:
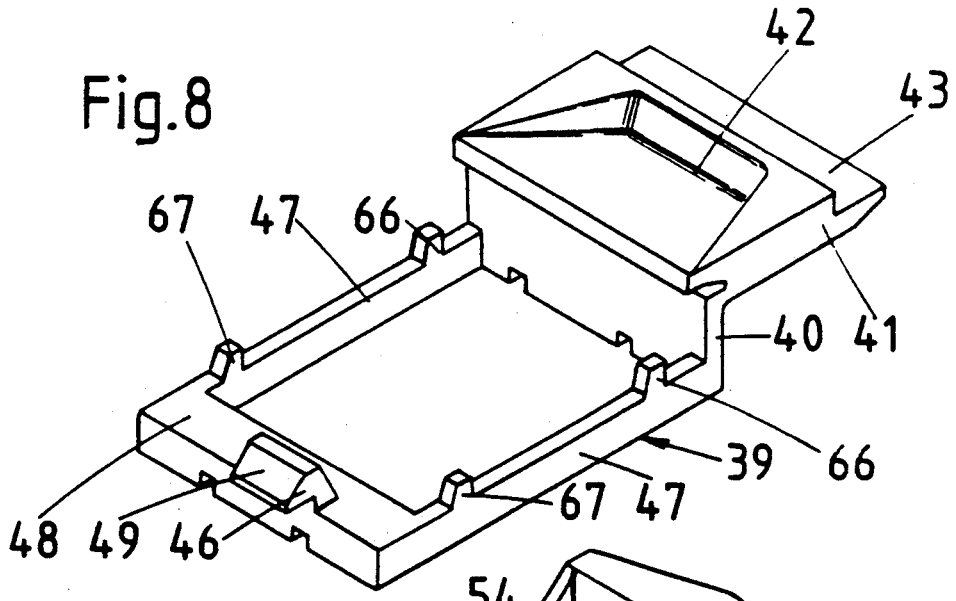
FIG. 8 is a perspective view of the latch slide.
Figure 9:
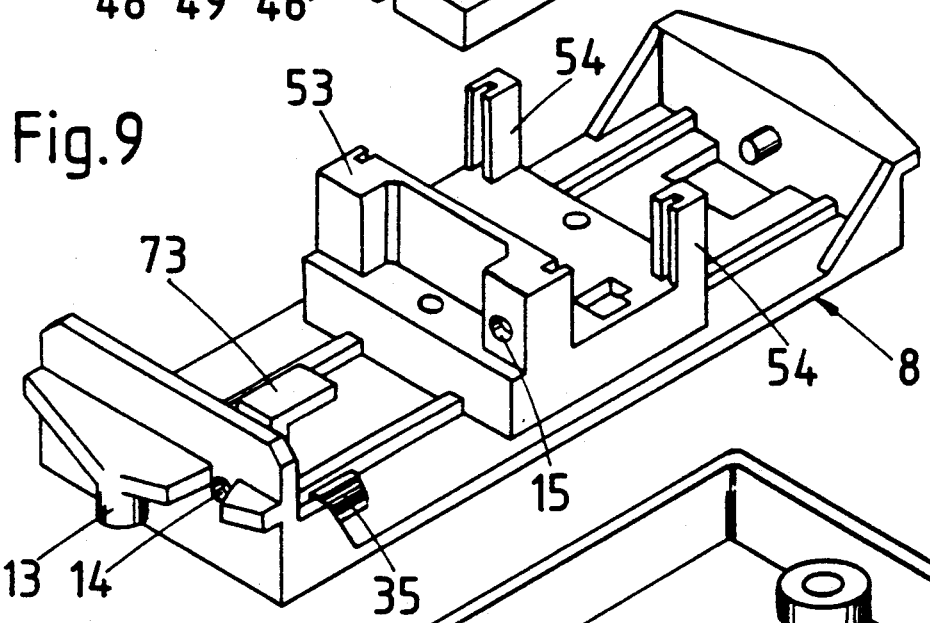
FIG. 9 is a perspective view of the base plate.
Figure 10:
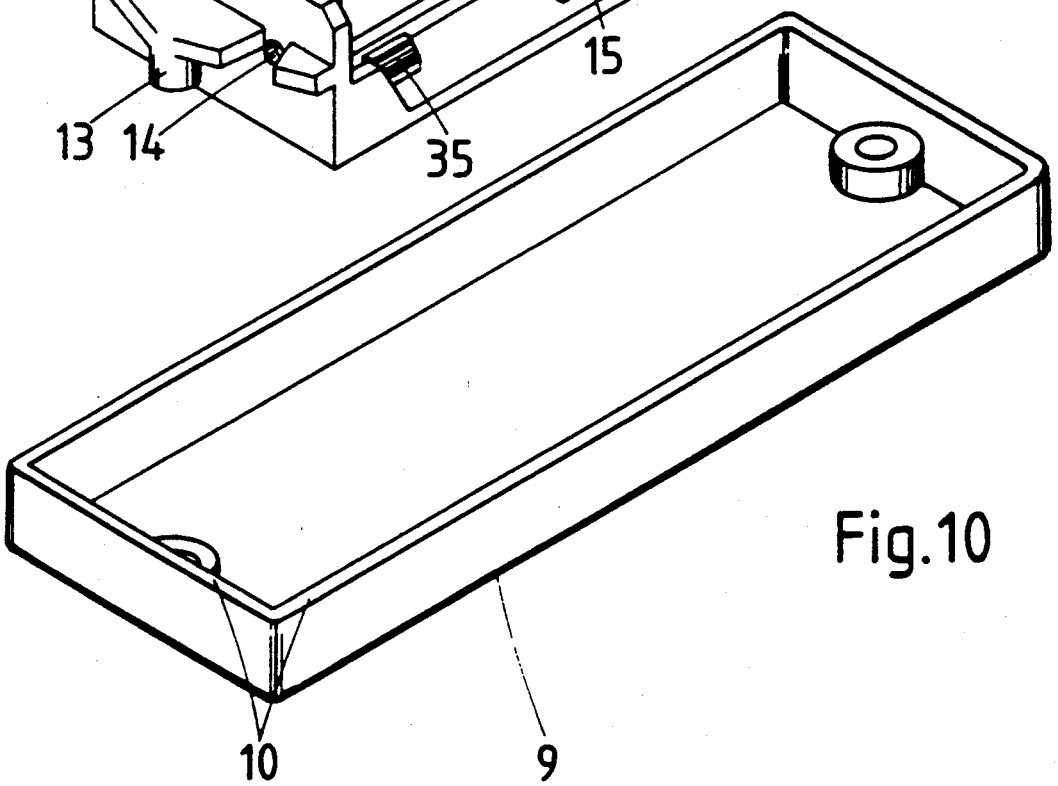
FIG. 10 is a perspective view of the lock housing cap.
Figure 11:
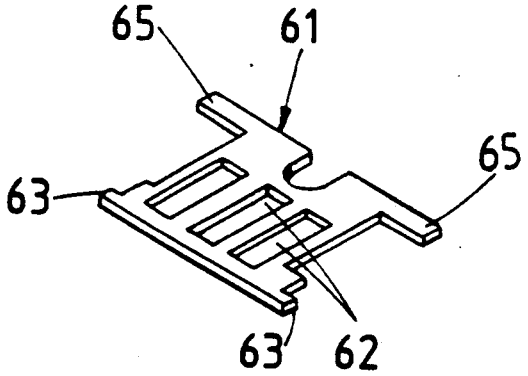
FIG. 11 is a perspective detail view of the blocking rocker.
Figure 12:
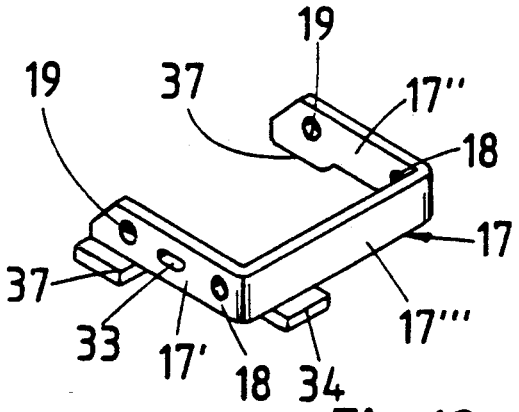
FIG. 12 is a perspective view of the U-shaped chain link.
Figure 13:
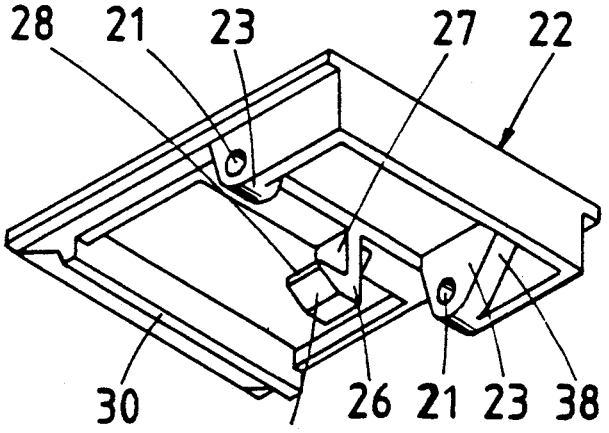
FIG. 13 is a perspective view of the bolt.
Figure 14:
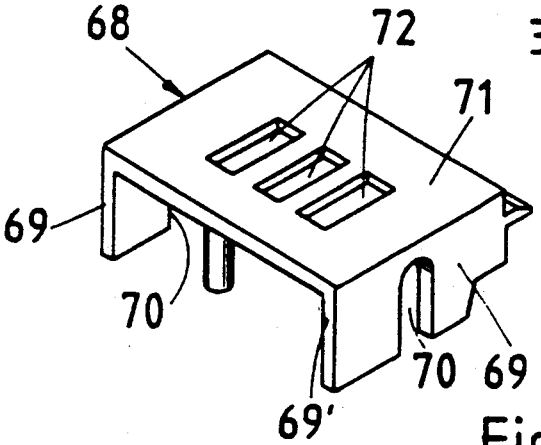
FIG. 14 is a perspective view of the housing cap associated with the permutation lock.

It can be noted in particular from FIG. 6 that the surface F of the bolt 22 terminates, in the locked position of the latter, flush with that of the housing cap 68 and the push button 41.

In the installed position of the latch slide 39, its position is secured by a hook 73 which extends from the base plate 8 and covers the facing transverse frame web 48 of the latch slide 39. When the latch slide 39 assumes its blocking position, the length of the covering is greater than the distance between the stops 67 thereof and the facing end 69' of the U-arm 69 of the housing cap 68. In this way, the result is achieved that with the latch slide 39 displaced into the release position, the covering of the transverse frame web 48 by the hook 73 is not relinquished. The installation of the latch slide 39 must be effected before the placing on of the housing cap 68. A larger displacement path of the latch slide 39 is then possible. The above-mentioned securing takes place only after the housing cap 68 has been placed on.

The lock 7 operates as follows:

When the lock 7 is in its locked position and the combination of the permutation lock has been scrambled, the position shown in FIG. 6 is present. The blocking sleeves 57 have swung the blocking rocker 61 in such a manner, that its blocking ends 65 lie in front of the blocking projections 66 of the latch slide 39 and prevent its displacement by the push button 41. The bolt 22 is accordingly not released for swinging into the open position.

The opening of the lock 7 requires the setting of the correct combination. The blocking sleeves 57 are thereby turned in such a manner that their flattenings 60 permit the swinging of the blocking rocker 61 into the release position. The blocking ends 65 move accordingly away from the blocking projections 66 of the latch slide 39. The latter can now be displaced by action on its push button 41 opposite the direction of the bolt 22 while compressing the compression spring 45. Simultaneously, the catch hook 46 of the latch slide 39 releases the pull 26 of the bolt 22. As a result thereof, the chain link 17 can swing, due to the spring action, into the spread-off position shown in FIG. 4, said swinging displacement being limited by the projection 35 of the lock base plate 8 in the manner that the stop tongue 34 comes against said projection 35. Simultaneously, the bolt 22 also swings, its tightening hook 30 leaving the mating lock part opening 31 in the suitcase lid 3 The swinging of the bolt 22, however, takes place in the opposite direction of turning. The swinging motion of the bolt 22 is limited by the fact that its counter stops 38 act on the stop shoulders 37 of the chain link 17. The suitcase lid 3 can now be opened. In moving from the latched to the unlatched position of the bolt 22, the end of the link connected to shaft 20 does not swing beyond a dead center imaginary line connecting shaft 16 and hook 30/opening 31 engagement.

Figure 4:
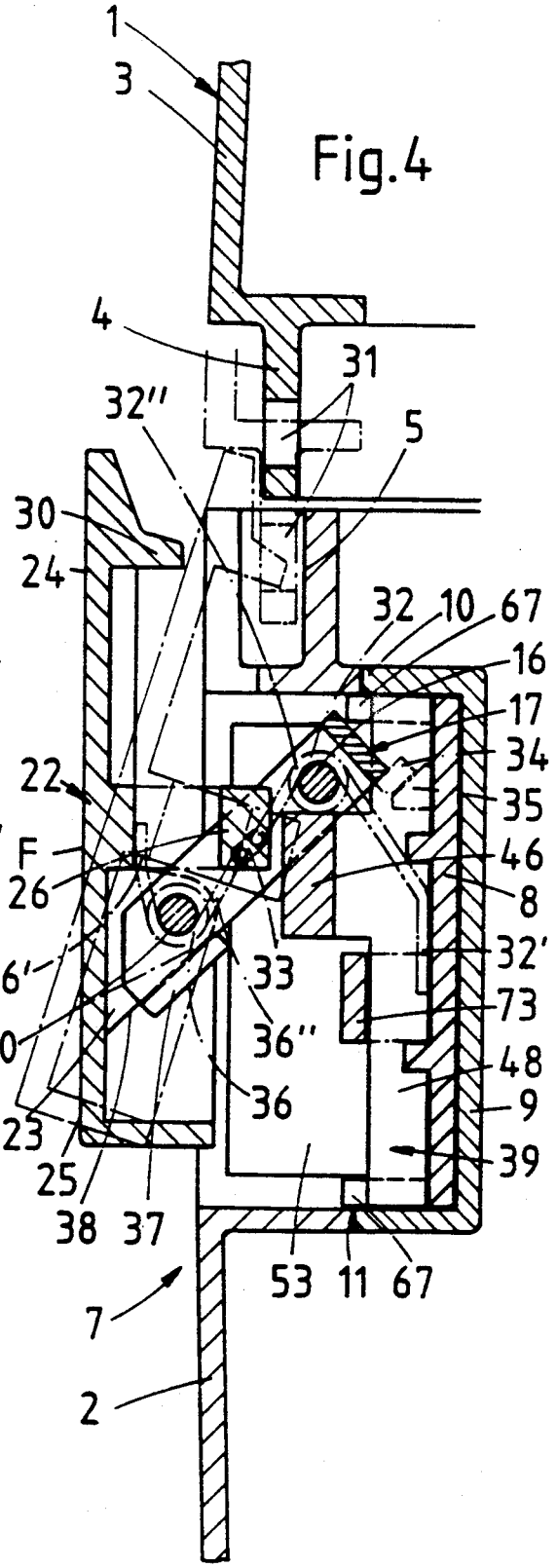
FIG. 4 is a view corresponding to FIG. 3 but in the open position of the bolt limited by stop.

In order to close the suitcase 1, the suitcase lid 3 must at least be brought into the position as shown in dash-dot line in FIG. 4. Thereupon, the locking is effected by means of a two-finger actuation. The bolt 22 is in this case preferably swung by means of one's index finger into the position indicated in dash-dot line in FIG. 4 in the manner that the index finger presses down on the actuating surface 24 of the bolt 22 and thereby brings the tightening hook 30 into engagement with the mating lock opening 31. The chain link 17 does not change its position in this connection. The actuating surface 25 of the bolt 22 must then be subjected to pressure by one's thumb, whereby the bearing shaft 20 can be displaced over an arcuate path, namely as a result of the swinging of the chain link 17 around the articulated shaft 16. In this connection, the tightening hook 30 of the bolt 22 brings about the longitudinal tightening which pulls the suitcase lid 3 into its locked position. In the final phase of the closing movement, the pull 26 acts with its run-on bevel 29 on the latch bevel 49 of the latch slide 39, which initially moves away against spring action and then grips over the head 28 of the pull 26 by return displacement of the latch slide 39. In this way, the bolt 22 is held in its locking position. The locking position can be secured in the manner that the setting disks 56 of the locking mechanism 50 are displaced. In this way, the blocking sleeves 57 are so turned that the blocking rocker 61 is swung then into the locking position in such a manner that their blocking ends 65 lie in the path of the blocking projections 66 of the latch slide 39.

We claim:

1. A locking device, particularly for suitcases, comprising a closure base plate, a link, and a pivot pin by which the link is pivoted to the base plate;

a bearing shaft disposed parallel to an axis of the pivot pin, a latch which has two actuating portions located on opposite sides of the bearing shaft, the link bearing the latch via the bearing shaft;

a lock, a latch slide having an actuating handle, and a closing part having an opening which mates with the latch, wherein a first of the latch actuating portions serves for a swinging displacement of the latch in a direction towards the mating closing part opening, and a second of the latch actuating portions produces, by application of actuation pressure and via a displacement of the link, a lengthwise pull on the latch into a locking position of the latch allowing the latch to be caught by the latch slide;

wherein the actuating handle is displaceable against spring action into a position of release and is closable against displacement into the position of release by the lock;

the actuating handle is disposed on an end of the latch slide which extends beyond the latch, the link between restrained from swinging beyond its dead center position and resting in locking position approximately parallel to a plane of displacement of the latch slide, the latch slide being movable under the lock by action of a part of the base place in an end region of the latch slide.

2. A locking device according to claim 1, wherein the latch is provided with a pull hook; and in a locked position of the latch, an edge of the latch opposite the pull hook of the latch and facing a bottom of the suitcase is arranged directly alongside of an edge of a bottom of the suitcase which is adjacent to the latch and extends at the same height.

3. A locking device according to claim 1, further comprising a claw which extends from the bottom of the latch; and wherein between the pivot pin and the bearing shaft, and upon a swinging displacement of the latch in a direction towards the mating closing-part opening, the claw which extends from the bottom of the latch swings inward and, in a locked position of the latch, is gripped over by a head of the latch slide, developed as catching hook of the latch slide.

4. A locking device according to claim 1, wherein the latch extends in a direction transverse to the direction of the actuating handle and the latch slide.

5. A locking device according to claim 1, wherein the bearing shaft is borne by the link which is seated swingable, and is limited by a stop, on the pivot pin of the lock base plate, said pivot pin being arranged parallel to the bearing shaft.

6. A locking device according to claim 5, wherein the link forms at least one stop shoulder against which a counter stop of the latch rests in an open position of the latch.

7. A locking device according to claim 6, further comprising torsion springs which are arranged on the bearing shaft and on the pivot pin and which urge both the link and the latch in the direction towards a stop limitation.

8. A locking device according to claim 7, wherein a force of the torsion spring acting on the latch is less than that of the torsion spring acting on the link.

9. A locking device according to claim 7, wherein the latch slide, which is guided by the lock base plate and urged by a spring in the direction towards its engagement with the latch, is of frame-shape and has on one end the actuating handle and on its other end a catch hook developed with a latch bevel, said hook extending in the locking position of the latch over a pull extending from the bottom side of the latch.

10. A locking device according to claim 1, wherein the lock extends between the actuating handle and the latch to block a sliding movement of the latch slide.

11. A locking device according to claim 1, wherein the lock is developed as a permutation lock having setting disks, a shaft which bears the setting disks extending transverse to a direction of displacement of the latch slide and having locking sleeves which cooperate with the setting disks and which, upon a setting of a combination, release a spring-urged blocking rocker which is associated with the latch slide.

12. A locking device according to claim 11, wherein blocking projections are formed on the latch slide and, in a locking position of the latch and upon a scrambling of the combination of the permutation lock, lie in front of blocking ends of the blocking rocker.

13. A locking device according to claim 12, wherein behind the blocking projections, additional stops are formed on the latch slide, a housing cap which extends over the permutation locking extending into the path of movement of

14. A locking device according to claim 13, further comprising a hook which secures a connected position of the lock base plate and the latch slide, and which extends over a facing transverse frame web of the latch slide in such a manner that a length of the extension is greater with the latch slide in a blocking position than the distance between the stops and a facing edge of the housing cap.

15. A locking device according to claim 13, with the latch in its locking position, flush with a surface of the housing cap and the actuating handle.

* * * * *